US005201349A

United States Patent [19]

Kraehn

[11] Patent Number: 5,201,349

[45] Date of Patent: Apr. 13, 1993

[54] DEVICE FOR PNEUMATICALLY TRANSFERRING TONER FROM A TRANSPORT CONTAINER INTO A TONER RESERVOIR

[75] Inventor: Erich Kraehn, Karlsfeld, Fed. Rep. of Germany

[73] Assignee: Siemens Aktiengesellschaft, Munich, Fed. Rep. of Germany

[21] Appl. No.: 947,996

[22] Filed: Sep. 21, 1992

Related U.S. Application Data

[63] Continuation of Ser. No. 820,030, Jan. 10, 1992, abandoned, which is a continuation of Ser. No. 490,675, Mar. 12, 1990, filed as PCT/DE88/00486, Aug. 5, 1988, abandoned.

[30] Foreign Application Priority Data

Sep. 10, 1987 [DE] Fed. Rep. of Germany ..... 3730454

[51] Int. Cl.[5] ..... B65O 1/04

[52] U.S. Cl. ..... 141/363; 141/364

[58] Field of Search ..... 141/67, 59, 363, 364

[56] References Cited

U.S. PATENT DOCUMENTS

| | | | |
|---|---|---|---|
| 3,883,240 | 5/1975 | Ito et al. | 355/3 |
| 4,029,047 | 6/1977 | Bell | 118/652 |
| 4,062,385 | 12/1977 | Katusha et al. | 141/89 |
| 4,561,759 | 12/1985 | Knott | 355/3 |
| 4,833,501 | 5/1989 | Büyükgüclüe | 335/3 R |

FOREIGN PATENT DOCUMENTS

| | | | |
|---|---|---|---|
| 0238939 | 5/1987 | European Pat. Off. | 355/3 R |
| 48307 | 7/1983 | Japan | 355/260 |
| 58-127960 | 7/1983 | Japan | 355/260 |

OTHER PUBLICATIONS

2244 Research Disclosure (1982) Jan. No. 213, Havant Hampshire, Great Britian.

vol. 10 No. 223 (P-483) [2279] Aug. 5, 1986 Pat. Ap. No. (11)61-59465.

vol. 8 No. 31 (P-253) [1468]Feb. 9, 1984 Pat Ap. No. (11) 58-184968 (A).

vol. 10 No. 353 (M-539) [2409] Nov. 28, 1986 Pat Ap. No. (11) 61-151675 (A).

*Primary Examiner*—Henry J. Recla
*Assistant Examiner*—David J. Walczak
*Attorney, Agent, or Firm*—Hill, Steadman & Simpson

[57] ABSTRACT

The device for pneumatically filling toner (23) from a transport container (22) into a toner reservoir (10), from where the toner (23) is then supplied to a developer station (11) of an electrophotographic printer means, contains a settling space (12) that is in communication with the developer station (11) and contains a suction space that is separated from the settling space (12) via filter means (14) and has a means (19) that generates a low pressure allocated to it. The settling space (12) comprises a scraper means (28) that strips toner adhering to the filter means (14) via elastic scraper elements (28).

6 Claims, 3 Drawing Sheets

DEVICE FOR PNEUMATICALLY TRANSFERRING TONER FROM A TRANSPORT CONTAINER INTO A TONER RESERVOIR

This is a continuation of Ser. No. 07/820,030, filed Jan. 10, 1992, now abandoned, which is a continuation of application Ser. No. 490,675, filed Mar. 12, 1990, filed as PCT/DE88/00486, Aug. 5, 1988 now abandoned.

The invention is-directed to an apparatus for pneumatically transferring toner from a toner container into a toner reservoir from which the toner is then supplied to a developer station of a non-mechanical printer or copier means.

In copier technology and in modern fast data printers that operate based on the principle of electrophotography, charge images are generated on a recording medium, for example, a photoconductive drum, or are generated directly on special paper and are subsequently inked with a black powder (toner) in a developer station. Given employment of an intermediate carrier, this toner image is subsequently transferred onto normal paper and is fixed thereon. A two-component developer that is composed of ferromagnetic carrier particles and of toner particles is usually used for developing. The developer is conducted past the charge image on the intermediate carrier with a magnetic brush arrangement, the toner remaining adhering to said intermediate carrier due to electrostatic forces.

German published application 21 66 667, for example, discloses an electrophotographic copying device that develops charge images according to the principle recited above.

Due to the inking of the charge images on the intermediate carrier, the toner concentration in the developer mix of the developer station constantly decreases. It is therefore necessary to constantly supply the developer mix with new toner in metered fashion. Since the toner consumption is extremely high per time unit in fast copier devices and high-performance data printers, a roomy toner reservoir is employed in such devices in order to avoid downtime due to replenishment of toner. When this toner reservoir is empty, the toner that is usually supplied in handy containers is filled into the reservoir. It is thereby important to fill the toner from the container into the reservoir such that no toner is spilled and thereby contaminates the environment.

German Patent 32 24 296, for example, discloses such a toner filling means.

There is then the risk in such toner filling means that toner will be spilled given manual transfer from the toner bottle. Since, moreover, the toner is only supplied to the toner reservoir at a defined location, special distributor devices in the toner reservoir are needed in order to guarantee a uniform delivery of the toner to the developer station.

In order to avoid these disadvantages in the known filling devices, it has already been proposed (European Patent Application 87103539.0) to remove the toner from the transport container, namely, the toner bottle, by suction with low pressure via a flexible line. The toner proceeds via the flexible line into a reservoir that is divided into a settling space and into a suction space separated from the settling space. The suction space is in communication with a vacuum pump that generates a low pressure as a result whereof the toner settles at the filter of the settling space. After the suction pump is shut-off, the toner falls onto a spiral conveyor arranged at the floor of the settling space, this spiral conveyor delivering the toner to the developer station of the printer in metered fashion.

It is an object of the present invention to fashion an apparatus of the species initially cited such that toner can be transferred from a simple, cost-beneficial transport container into a reservoir at the apparatus side that has a high capacity without toner caking thereby occurring and without the toner being spilled.

In an apparatus of the species initially cited, this object is achieved by an apparatus having a settling chamber that is in communication with the developer station and has a suction chamber that is separated from the settling chamber via a filter means and that has an allocated means that generates low pressure; and by the settling chamber having a scraper means that strips toner adhering to the filter means via scraper elements.

Advantageous embodiments of the invention are provided by the filter means being cylindrically formed and the scraper elements being conducted past the filter means in a rotary motion via a drive means. Furthermore, the scraper elements are preferably elastically formed and press resiliently against the filter means. The scraper elements are composed of stirrup-shaped spring elements secured to a common rational axis. The filter means may include a lattis shaped carrier part and a filter element connected to the carrier part. A metering means which supplies toner to the developer station is arranged on the floor of the settling chamber. The metering means preferably comprises at least one metering drum composed of cellular like material.

In the invention, the toner is advantageously removed from a transport container, namely, the toner bottle, by suction with low pressure via a flexible line. The toner proceeds via the flexible line into a reservoir that is divided into a settling space and into a suction space separated from the settling space. The suction space is in communication with a vacuum pump that generates a low pressure, whereupon the toner settles at the filter of the settling space. The toner that has adhered to the filter means is stripped with the assistance of elastic scraper elements and falls onto the floor of the settling space in which a metering means that supplies the toner to the developer station of the printer in metered fashion is situated.

The metering means contains at least one metering drum composed of cellular-like material that conveys the toner from the settling space into the developer station.

The arrangement of two oppositely moving drums of cellular material that enable an exact metering is thereby advantageous.

A clumping of the toner cannot occur since the toner is not mechanically compressed.

The filter means itself is advantageously composed of a lattice-shaped carrier part and of a filter weave joined to the carrier part, whereby the carrier part can be composed of plastic that comprises a multitude of openings that can be arranged such that a uniform distribution of the toner in the reservoir derives. The carrier part thereby assumes the function of a compression distributing plate.

A clumping of the toner cannot occur since the toner is not mechanically compressed.

Embodiments of the invention are shown in the drawing and shall be set forth in greater detail below by way of example.

Figure 1:
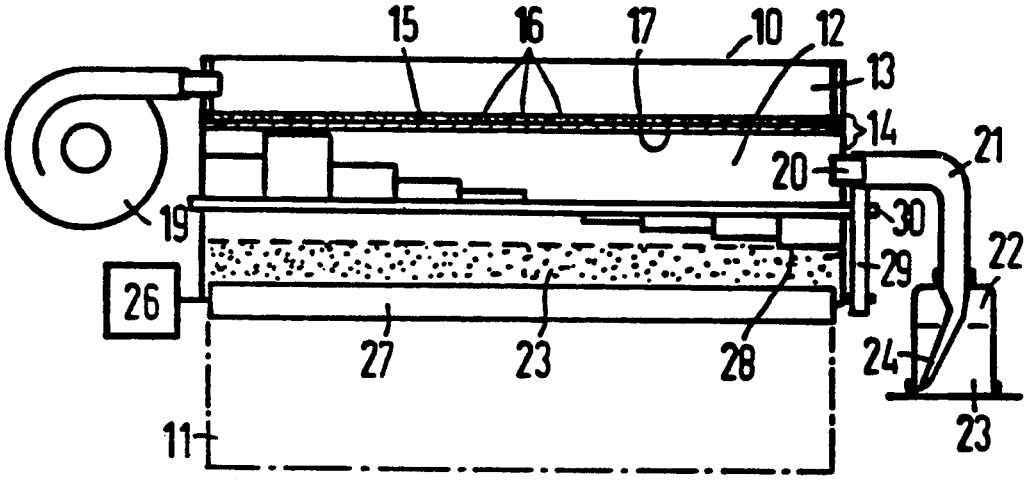
FIG. 1 is a schematic illustration of a device for filling toner from a toner container into a toner reservoir, shown in part sectionally.

A toner reservoir 10 from which the toner is supplied to a developer station 11 for developing charge images is situated in a non-mechanical fast printer (not shown here) that works according to the principle of electrophotography. The toner reservoir 10 has the approximate width of the developer station 11, this approximately corresponding to the printing width and is divided into a settling space 12 and into a suction space 13. The spaces are separated from one another by a filter means 14. The filter means is closed off from the suction space 13 y a lattice-shaped carrier part 15 having a plurality of openings 16 arranged thereon. The actual, toner-tight filter 17 that, for example, can be composed of a glass mat is joined to the lattice-shaped carrier part 15. This filter 17 has its edges sealed by strips of cellular material. The openings of the lattice-shaped carrier part 15 preferably composed of plastic can be arranged and dimensioned in accord with the desired pressure distribution of the suction air.

The suction space 13 is in communication with an electromotively driven under-pressure pump 19. The settling space 12 in turn has a connecting branch 20 to which a flexible tube conduit 21 is connected in the form of a sucking tube.

For transferring toner 23 delivered in toner bottles 22 into the reservoir 10 or, respectively, into the developer station 11, the flexible, tube-shaped suction line 21 has its suction connector 24 introduced into the toner bottle 22 and the suction pump 19 is then actuated. The low pressure generated in the suction space 13 that acts uniformly via the openings 16 of the lattice-shaped carrier part 15 generates a corresponding low pressure in the settling space 12, as a consequence whereof the toner 23 is sucked into the settling space 12 according to the "vacuum cleaner principle". The toner settles under the filter means 14, namely uniformly over the entire width of the toner reservoir.

A motor-driven scraper means is arranged in the settling space 12, this scraper means stripping the toner that adheres to the filter means 14 with scraper elements 28.

Figure 2:
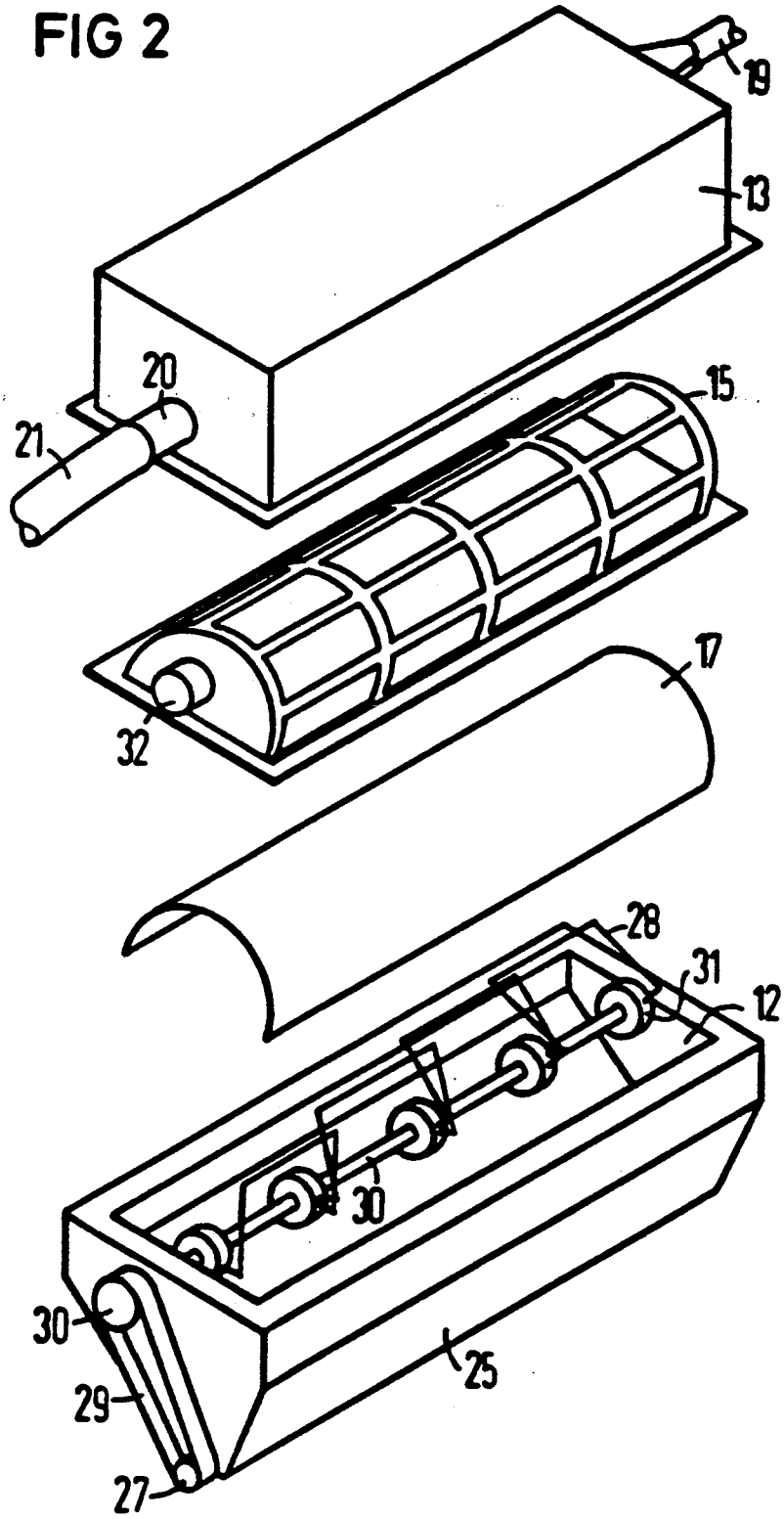
FIG. 2 is a schematic, exploded view of the same device.
Figure 3:
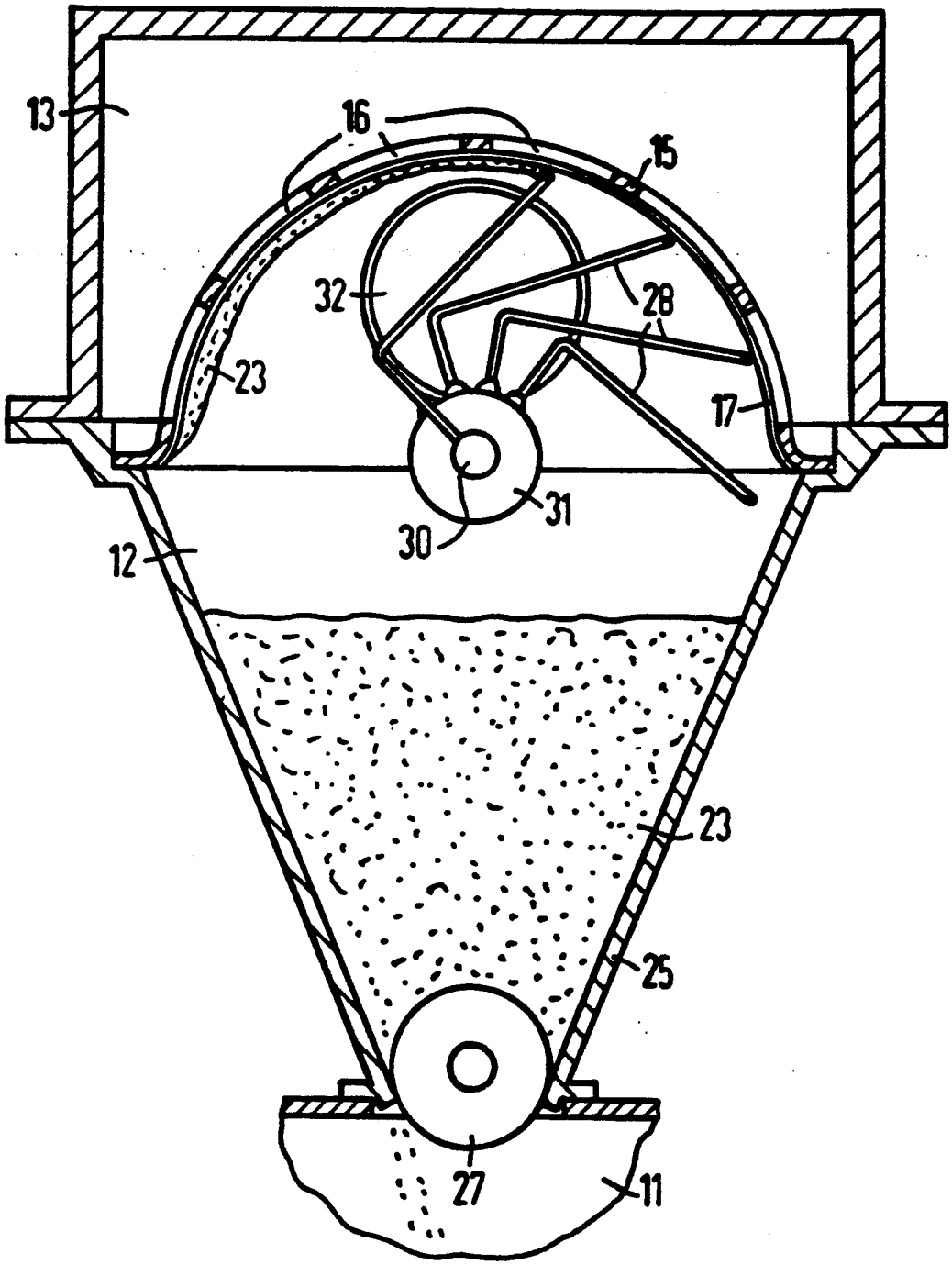
FIG. 3 is a schematic, sectional view of the filling means with appertaining metering means.

The toner falls into the lower, conically tapering region 25 of the settling space (FIG. 2) and deposits there. A metering means in the form of a drum 27 of cellular material (FIG. 3) driven via a motor 26 is arranged at the lower region 25 of the conically fashioned settling space 12. The circumference of this drum of cellular material brushes against the lower edge of the conically tapering settling space 25 and convey toner 23 to the developer station 11 dependent on a level metering means (not shown here).

In an embodiment of the invention that is not shown here, two drums of cellular material arranged side-by-side can also be provided as metering devices, these being oppositely driven and the toner then being supplied to the developer station between the drums.

The drive of the metering means is coupled to the shaft 30 of the scraper means via a belt 29. However, it is also possible to separately drive the scraper means and the metering means via motor means.

The scraper means itself comprises a plurality of elastic scraper elements 28 composed of spring steel wire that are secured to the shaft 30 of the scraper means with fastening disks 31. Due to their flexible shape, the scraper elements 28 press lightly and resiliently against the filter mat 17 and thus scrape the adhering toner off given a rotatory motion. The filter mat 17 can thereby be bonded to the lattice-shape carrier part composed of plastic, whereby the lattice-shaped carrier part 15 together with the filter mat 17 can form a wear part. The arrangement composed of lattice part 15 and filter mat 17 is interchangeably placed onto the settling space 12 in air-tight fashion.

An admission opening 32 that can be adapted to the corresponding opening 20 of the suction tube 21 in air-tight fashion and that forms the passage to the suction space 12 is situated at the end face of the lattice-shaped carrier part 15

The scraper elements 28 fashioned as rotatory scraper can be glued and/or soldered to the fastening disks 31 connected to the shaft 30.

Although other modifications and changes may be suggested by those skilled in the art, it is the intention of the inventor to embody within the patent warranted hereon all changes and modifications as reasonably and properly come within the scope of his contribution to the art.

I claim:

1. An apparatus for pneumatically transferring toner from a toner container into a toner reservoir from which the toner is then supplied to a developer station of a non-mechanical printer or copier means, comprising:

a toner reservoir having a settling chamber adapted to be in communication with the developer station and adapted to be in communication with the toner container, and the toner reservoir having a suction chamber in communication with the settling chamber; and a filter separating the suction chamber from the settling chamber, said filter having a semi-cylindrical shape centered on an axis in said settling space; and an allocated means for generating a low pressure in said suction chamber to draw toner-ladened air from the toner container into the settling chamber and to draw air from the settling chamber through the filter into the suction chamber thereby depositing toner on the filter;

a scraper means for stripping toner adhering to the filter via scraper elements, said scraper elements being mounted on a rotatable shaft, said rotatable shaft extending substantially along said axis, said scraper elements having a length extending to bear against said filter during rotation of said rotatable shaft; and means for driving said rotatable shaft.

2. An apparatus according to claim 1, wherein said scraper elements are of elastic material and are mounted on said rotatable shaft to press resiliently against the filter.

3. An apparatus according to claim 2, wherein said scraper elements are composed of stirrup-shaped spring elements secured on said rotatable shaft along a common

4. An apparatus according to claim 1, wherein said filter comprises a semi-cylindrical shaped carrier part of an open lattice work, and a filter fabric connected on a radially inside surface of said semi-cylindrical carrier part so that said scraper elements move over an inside surface of said filter fabric as said rotatable shaft is rotated by said drive means.

5. An apparatus according to claim 1, further comprising: a metering means for supplying toner to the developer station arranged at a floor of the settling chamber.

6. An apparatus according to claim 5, wherein said metering means comprises at least one metering drum composed of cellular-like material.

* * * * *